US005988382A

United States Patent [19]

Ritchie et al.

[11] Patent Number: 5,988,382

[45] Date of Patent: Nov. 23, 1999

[54] SCREWDRIVER HOLDER

[75] Inventors: Fred Philip Ritchie; David Allen Trower, both of Waterloo, Iowa

[73] Assignee: Waterloo Industries, Inc., Waterloo, Iowa

[21] Appl. No.: 09/207,447

[22] Filed: Dec. 8, 1998

[51] Int. Cl.[6] ..... B65D 85/20; B65D 1/36

[52] U.S. Cl. ..... 206/372; 206/565; 211/70.6

[58] Field of Search ..... 206/372–375, 206/564, 565, 523; 211/70.6

[56] References Cited

U.S. PATENT DOCUMENTS

| | | | |
|---|---|---|---|
| 2,287,425 | 6/1942 | Fox | 206/564 |
| 2,487,174 | 11/1949 | Petre | 206/374 X |
| 2,591,805 | 4/1952 | Gossett | 211/70.6 X |
| 2,694,485 | 11/1954 | Naker | 206/373 |
| 3,489,268 | 1/1970 | Meierhoefer | 206/565 X |
| 5,005,710 | 4/1991 | Hofer | 211/70.6 |
| 5,320,223 | 6/1994 | Allen | 206/372 |
| 5,730,303 | 3/1998 | Chow | 211/70.6 |

FOREIGN PATENT DOCUMENTS

| | | | |
|---|---|---|---|
| 2412465 | 8/1979 | France | 206/564 |
| 003946 | 2/1906 | United Kingdom | 206/372 |

OTHER PUBLICATIONS

NAPA Hand Tool/Storage advertising flier.
W.I.I. Customer Bri–Tool Catalog (England Distributor).
Tool Caddy Sears Power and Hand Tool Catalog herein as (SPHTC), p. 134, 1982/83.
Plastic Holder, p. 143, SPHTC 1982/83.
Magnetic Strip (back page) 1982/83 SPHTC.
Stool Caddy, p. 75, SPHTC 1983/84.
Plastic Vinyl Storage Case, p. $34_2$, SPHTC 1990.
Tool Storage Hooks (pegboard), p. 14, SPHTC 1992/93.
Tool Storage Cases, p. 19, SPHTC 1998/99.
Steel Screw Drive Holder and Soft Side Fold Up Cloth Case, SPHTC 1998/99, p. 20.
Plastic Blow Mold Tool Cases, p. 36, SPHTC 1998/99.
Plastic Storage Cases, p. 55, SPHTC 1998/99.
Plastic Case, p. 59, SPHTC 1998/99.

*Primary Examiner*—Bryon P. Gehman
*Attorney, Agent, or Firm*—Banner & Witcoff, Ltd.

[57] ABSTRACT

A screwdriver holder or carrier includes two series of parallel troughs arrayed sequentially and in alternating rows with a handle support wall separating the troughs. The blades fit through a double molded wall construction with a foam insert held therein. The foam insert, in at least in part, frictionally engages the screwdriver blades to hold them in the carrier. The assembly further includes a blade guard at one end and a handle at its opposite end.

7 Claims, 4 Drawing Sheets

FIG. 6
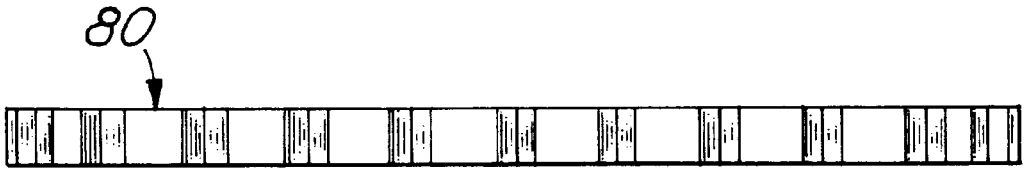
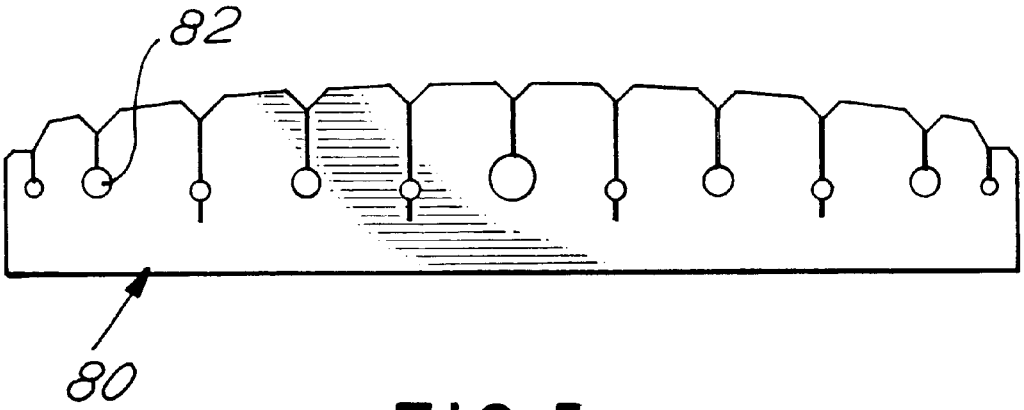
FIG. 5

SCREWDRIVER HOLDER

BACKGROUND OF THE INVENTION

This invention relates to a carrier or holder for screwdrivers and similar tools.

Construction workers, mechanics and other tradesmen often utilize screwdrivers of the type having a handle with a projecting blade. Screwdrivers come in various types and sizes. The length of the blade, the size of the handle, the size of the blade, the offset of the blade and the head or point of the blade are variable features of screwdrivers required or available depending upon the fastener or other item which the screwdriver is designed to engage. In order to organize a collection of screwdrivers, various holders, cases or carriers have been made available. Typically, such cases or carriers are formed of blow molded plastic and provide variously sized troughs or pockets for receipt of each screwdriver tool.

While many such holders are available for use by mechanics and others, there has, nonetheless, remained a desire and need for an improved carrier of the type which will securely retain each screwdriver from a set in an organized fashion, permit carriage of a screwdriver or set of screwdrivers easily, and further provide secure storage of multiple tools. These desires, among others, inspired the development of the present invention.

SUMMARY OF THE INVENTION

In a principal aspect, the present invention comprises a molded plastic screwdriver carrier or holder for storage of a multiple number of screwdrivers. The holder includes preferably, a first and a second tray, each tray comprised of a plurality of parallel troughs. The trays are separated one from the other by a wall having slots for receipt of the blades of screwdrivers. Adjacent one end of one tray are molded parallel spaced walls into which an elastic insert is positioned intermediate the walls to engage and retain the blades of screwdrivers projecting through slots in the walls and insert at least in part by frictional engagement. The holder further includes additional features such as a handle, covers, and flanges for protecting and retaining the screwdriver blades.

Thus, it is an object of the invention to provide an improved molded plastic screwdriver holder for storage of multiple screwdrivers of various sizes having blades of various lengths.

Yet a further object of the invention is to provide a molded plastic screwdriver holder of the type which may be easily transported.

A further object of the invention is to provide a screwdriver holder which will securely retain multiple screwdrivers within the holder yet which permits easy removal from, and access to, each screwdriver.

Another object of the invention is to provide an economical, lightweight and highly functional screwdriver holder.

These and other objects, advantages and features of the invention will be set forth in the detailed description which follows.

DESCRIPTION OF THE DRAWING

In the detailed description which follows, reference will be made to the drawing comprised of the following figures:

FIG. 5 is an elevation of the foam insert utilized in combination with the holder of the invention; and FIG. 6 is a top elevation view of the insert of FIG. 5.

DESCRIPTION OF THE PREFERRED EMBODIMENT

Figure 1:
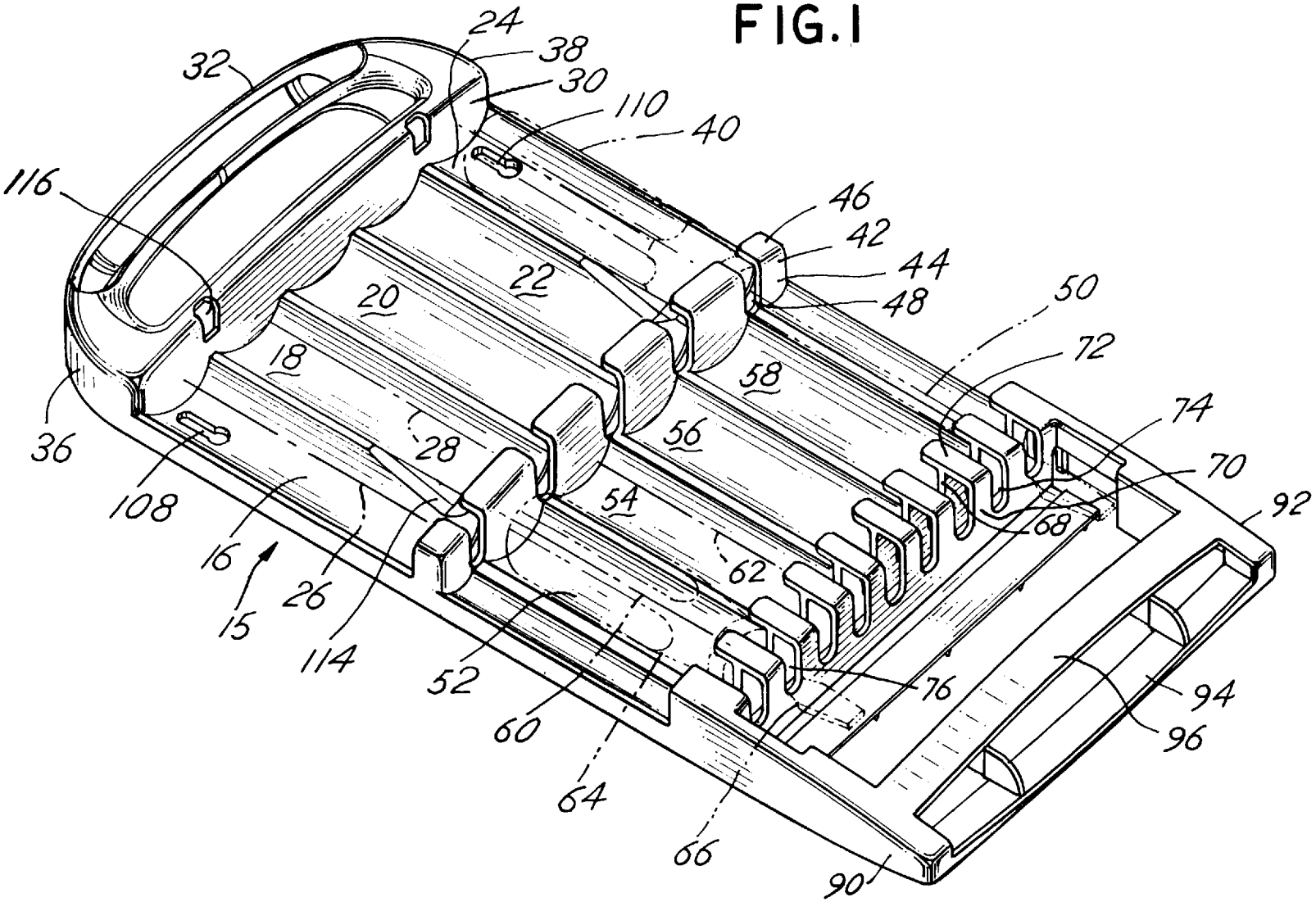
FIG. 1 is an isometric view of the tool holder of the invention.
Figure 2:
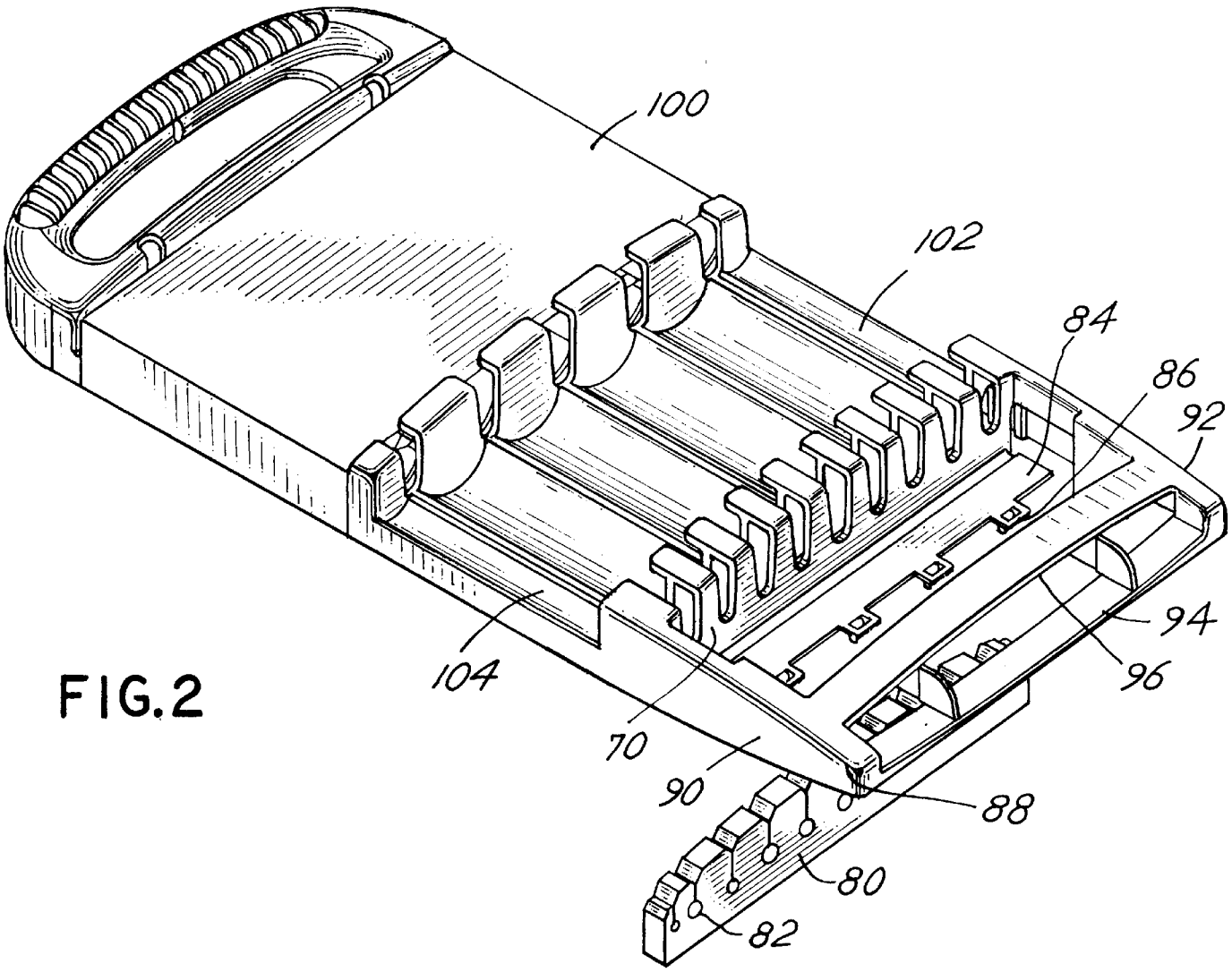
FIG. 2 is an exploded isometric view of the tool holder in FIG. 1.
Figure 3:
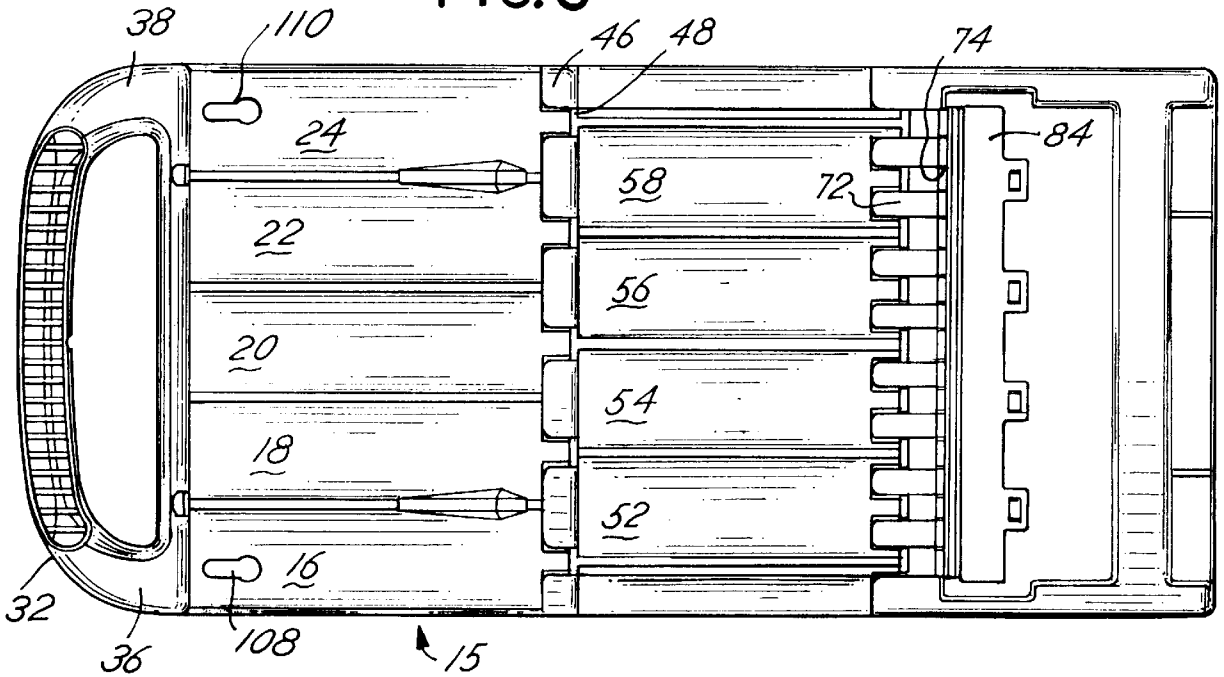
FIG. 3 is a top plan view of the tool holder of FIG. 1.
Figure 4:
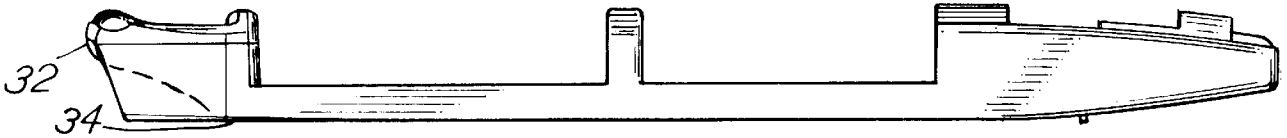
FIG. 4 is a side elevation of the tool holder of FIG. 1.

Referring to the figures, the holder of the invention includes a first tray or set 15 of parallel troughs 16, 18, 20, 22 and 24. The troughs 16, 18, 22 and 24 are arrayed side by side and generally parallel to each other. Each of the troughs 16, 18, 20, 22 and 24 defines a center line axis such as axis 26 or axis 28 for troughs 16 and 18. The axes 26, 28 are parallel and are directed from the top of the holder toward the bottom end. The holder is made from a molded plastic material, typically. The troughs, 16, 18, 20, 22 and 24 are connected along their top edge by a transverse wall 30 which spans the transverse dimension defined by the trays 16, 18, 20, 22 and 24. The wall 30 is connected with an arcuate, molded plastic handle 32. The handle 32, as more fully illustrated in FIG. 4, is elevated above a plane defined by the bottom or lower surface 34 of the holder. In this manner, when the holder of the invention is positioned on a horizontal surface, one may insert their hand underneath the handle 32 and easily grasp and grip the carrier or holder. The sides of the handle, for example, sides 36 and 38 are, however, defined by flanges which provide rigidity and support to the handle 32 configuration. It is noted that the wall 30 may, in fact, be a double wall construction to further enhance the rigidity of the carrier or screwdriver holder.

Of course, each trough, e.g., trough 24, is designed to hold the head or handle of a screwdriver as indicated in phantom with respect to trough 24 wherein a head or handle 40 is rested in the trough 24. The troughs 16, 18, 20, 22 and 24 further include a transverse support wall 42 at their lower end. The support wall 42 includes a vertical upstanding section 44 and a flange section 46. The wall 42 further includes a series of slots, such as slot 48, for receipt of a screwdriver blade such as blade 50. The handle 40 is thus supported by the wall 42 and the blade 50 projects therethrough as will be described in further detail below.

In the embodiment of the carrier or holder depicted, the carrier includes a further set or series of troughs 52, 54, 56 and 58. Each of the troughs 52, 54, 56 and 58 likewise includes a center line axis such as axes 60 and 62. The troughs 52, 54, 56 and 58 are parallel to one another and extend longitudinally with their axes 60 and 62, by way of example. The axes 60 and 62 are offset transversely from the axes 26, 28 of the troughs 16, 18, 20, 22 and 24 and are substantially midway between those axes 26, 28. In this manner, a head of a screwdriver, for example, head 64, may be positioned intermediate the heads and projecting blades of screwdrivers positioned in troughs 16 and 18. Blade 66 then associated with the head 64 will project intermediate blades associated with screwdrivers in troughs 16 and 18.

The bottom end of the troughs 52, 54, 56 and 58 are bounded by a transverse, double wall construction comprised of a first wall 68 and a spaced second wall 70 connected by a flange 72. The flange 72 also extends upwardly so as to help encapsulate, capture, or retain the head of a screwdriver in its associated trough. The walls 68 and 70 are spaced from one another and a series of slots 74 are provided therein. Alternate slots 74 are aligned with slots 48 in the wall 42. Remaining slots such as a slot 76 are aligned with a center line axis 60 of trough 52 for receipt of a blade of a screwdriver such as screwdriver 64 and blade 66 in the troughs 52. In this manner, alternate slots are associated with troughs 52, 54, 56 and 58.

The space between the walls 68 and 70 receives a foam insert 80. The foam insert 80 includes shaped passages such as passage 82 which are aligned with appropriate slots 74, 76, etc. The foam insert 80 is retained in position by a flap or wing 84 which is hinged by a molded living hinge to the lower side of the forward wall 70 and which includes fasteners 86 which lock the hinge 84 in place and thereby hold the foam insert 80 in place. The foam insert 80 is elastic in nature and is designed or configured so as to at least, in part, frictionally engage with blades, such as blade 66 of a screwdriver held in the tray.

A guard or blade protection assembly 88 is comprised of side wings 90 and 92 which extend along the edges of the tray and a cross member 94 which connects the side legs or wings 90 and 92. In this manner, screwdriver blades may project into the region defined between the legs 90 and 92 and be protected. Cross member 96 is also provided to retain blades conveniently within the assembly defined by the carrier and so that they will not be accidentally ejected. The member or brace 96 thus provides a blade guard. The cross member 96 thus protects the blades and protects the user of the tray from access to the blades thereby preventing injury, for example. An optional cover 100 may be placed over either set of the troughs. Optional miniature trays or side trays 102 and 104 may be included with respect to the lower troughs 52, 54, 56 and 58 to hold a small handled screwdriver. The tray or holder may be hung on a wall by fasteners attached through openings 108 and 110.

Offset screwdrivers may be inserted and held by the cooperative interaction of detent or depression 114 in combination with slot 116. All told, thirteen separate screwdrivers may be retained by the holder or carrier of the invention, including two offset screwdrivers, screwdrivers positioned in troughs 16, 18, 20, 22, 24, 52, 54, 56 58 and the side troughs 50 on each side of the tray, and detents 116.

It is possible to vary the construction of the screwdriver holder or carrier assembly of the invention without departing from the spirit and scope of the invention. For example, additional troughs may be provided. The foam insert 80 construction and configuration may be varied. The shape and configuration of the troughs may be varied. The positioning of the transverse walls may be adjusted. Thus, while there has been set forth a preferred embodiment of the invention, it is to be understood the invention is to be limited only by the following claims and equivalents thereof.

We claim:

1. A molded plastic screwdriver holder for storage of a multiple number of screwdrivers each having a handle with a center line axis and a blade projecting from the handle, said holder comprising, in combination:

a tray having a plurality of generally parallel troughs, each trough defining an axis, said troughs and axes being aligned side by side whereby each trough is positioned to receive and support a separate screwdriver handle;

a blade engagement section transverse to the axes, said blade engagement section including first and second molded, spaced walls transverse to the axes and positioned for intersection by blades of screwdrivers in the troughs, said walls including aligned slots for receipt of the blades; and an elastic insert intermediate the walls, said insert including blade slots aligned with the blade slots in the walls for receipt and retention of blades by, at least in part, frictional engagement with the blades.

2. The holder of claim 1 including a first set and second set of parallel, side by side, aligned troughs, said first set having said first set trough axes offset laterally with respect to the trough axes of the second set, said axes of said first set axially aligned parallel with the axes of said second set, said first set and said second set separated by a molded wall having wall slots for passage of blades, said wall slots of said molded wall aligned with slots of said blade engagement section.

3. The holder of claim 1 or 2 wherein at least one wall transverse to the troughs includes axial flanges for retaining screwdriver handles in the troughs.

4. The holder of claim 1 further including a holder handle affixed to the troughs for carriage of the holder.

5. The holder of claim 1 wherein the elastic insert comprises a foam material positioned in a pocket defined between the walls defining the blade engagement section.

6. The holder of claim 5 further including a hinged retainer flap attached to the holder for retaining the insert in the pocket.

7. The holder of claim 1 including a cover for the troughs to retain the handles of screwdrivers therein.

* * * * *